US005411004A

United States Patent [19]

Busato et al.

[11] Patent Number: 5,411,004

[45] Date of Patent: May 2, 1995

[54] POSITIVE PRESSURE CANISTER PURGE SYSTEM INTEGRITY CONFIRMATION

[75] Inventors: Murray F. Busato; John E. Cook, both of Chatham, Canada

[73] Assignee: Siemens Automotive Limited, Chatham, Canada

[21] Appl. No.: 13,594

[22] Filed: Feb. 3, 1993

[51] Int. Cl.[6] ..... F02M 33/02

[52] U.S. Cl. ..... 123/520; 123/198 D

[58] Field of Search ..... 123/198 D, 520, 521, 123/518, 519, 516; 73/40

[56] References Cited

U.S. PATENT DOCUMENTS

| | | | |
|---|---|---|---|
| 5,022,364 | 6/1991 | Phillips | 73/40 |
| 5,048,493 | 9/1991 | Orzel | 123/520 |
| 5,143,035 | 9/1992 | Kayanuma | 123/198 D |
| 5,146,902 | 9/1992 | Cook | 73/40 |
| 5,191,870 | 3/1993 | Cook | 123/198 D |
| 5,212,979 | 5/1993 | Albrodt | 73/40 |
| 5,220,822 | 6/1993 | Tuma | 73/40 |
| 5,230,319 | 7/1993 | Otsuka | 123/198 D |

*Primary Examiner*—Carl S. Miller
*Attorney, Agent, or Firm*—George L. Boller; Russel C. Wells

[57] ABSTRACT

The tank/canister volume's integrity against unacceptable leakage measured by a diagnostic test performed by an on-board diagnostic system which includes an electrically operated air pump and tank-mounted analog pressure transducer. At the beginning of a test, the engine management computer closes the canister purge solenoid valve and operates the pump to begin pressurization of the tank/canister volume. The pumped air is introduced via the canister's atmospheric vent port at a regulated pressure. Failure to build tank pressure to a predetermined pressure within a predetermined time indicates a gross leak. If no gross leak exists, the pressure will build, and the time required to build to a given pressure from the start pressure provides a measurement of any leakage that may be present. The fuel fill level in the tank affects this time, and it is taken into account in the measurement.

15 Claims, 1 Drawing Sheet

POSITIVE PRESSURE CANISTER PURGE SYSTEM INTEGRITY CONFIRMATION

FIELD OF THE INVENTION

This invention relates generally to evaporative emission control systems that are used in automotive vehicles to control the emission of volatile fuel vapors. Specifically the invention relates to an on-board diagnostic system for determining if a leak is present in a portion of the system which includes the fuel tank and the canister that collects volatile fuel vapors from the tank's headspace.

REFERENCE TO A RELATED PATENT

In certain respects this invention is an improvement on the invention of Applicants' commonly assigned U.S. Pat. No. 5,146,902.

BACKGROUND AND SUMMARY OF THE INVENTION

A typical evaporative emission control system in a modern automotive vehicle comprises a vapor collection canister that collects volatile fuel vapors generated in the fuel tank. During conditions conducive to purging, the canister is purged to the engine intake manifold by means of a canister purge system that comprises a canister purge solenoid valve that is operated by an engine management computer. The canister purge valve is opened in an amount determined by the computer to allow the intake manifold vacuum to draw vapors from the canister through the valve into the engine.

U.S. governmental regulations require that certain future automobiles that are powered by volatile fuel such as gasoline have their evaporative emission control systems equipped with on-board diagnostic capability for determining if a leak is present in a portion of the system which includes the fuel tank and the canister. One proposed response to that requirement is to connect a normally open solenoid valve in the canister vent, and to energize the solenoid when a diagnostic test is to be conducted. A certain vacuum is drawn in a portion of the system which includes the tank headspace and the canister, and with the canister and the tank headspace not being vented due to the closing of the canister vent, a certain loss of vacuum over a certain time will be deemed due to a leak. Loss of vacuum is detected by a transducer mounted on the fuel tank. Because of the nature of the construction of typical fuel tanks, a limit is imposed on the magnitude of vacuum that can be drawn. Too large a vacuum will result in deformation and render the measurement meaningless. In order to avoid this problem, a relatively costly vacuum transducer is required. Since typical automotive vehicles are powered by internal combustion engines which draw intake manifold vacuum, such vacuum may be used for performance of the diagnostic test, but typically this requires that the engine be running in order to perform the test.

The invention disclosed in commonly assigned allowed application Ser. No.: 07/770,009, filed Oct. 2, 1991, provides a solution to the leak detection problem which is significantly less costly. The key to that solution is a new and unique vacuum regulator/sensor which is disposed in the conduit between the canister purge solenoid and the canister. The vacuum regulator/sensor is like a vacuum regulator but with the inclusion of a switch that is used to provide a signal indicating the presence or the absence of a leak. A diagnostic test is performed by closing the tank vent and using the engine manifold vacuum to draw, via the canister purge solenoid valve and the vacuum regulator/sensor, a specified vacuum in the tank headspace and canister. Upon the requisite vacuum having been drawn, the vacuum regulator/sensor closes to trap the drawn vacuum. If unacceptable leakage is present, a certain amount of vacuum will be lost within a certain amount of time, and that occurrence causes the switch of the vacuum regulator/sensor to give a signal indicating that condition.

U.S. Pat. No. 5,146,902 discloses a diagnostic system and method for evaluating the integrity of a portion of the canister purge system that includes the tank and canister by means of positive pressurization rather than negative pressurization (i.e., rather than by drawing vacuum). In certain canister purge systems, such a diagnostic system and method may afford certain advantages over the system and method described in the aforementioned commonly assigned allowed patent application.

For example, certain types of leaks, for example cracked hoses and faulty gas caps, may be more susceptible to successful detection. Moreover, the evaporative emission control system may be diagnosed either with or without the automobile's engine running. One means to perform positive pressurization of the fuel tank's headspace and the canister is a devoted electric-operated air pump, which can be of quite simple construction, and therefore relatively inexpensive. If the vehicle already contains a source of suitably pressurized air, that could constitute another means, thereby eliminating the need for a separate devoted pump. Another means for performing positive pressurization of the tank's headspace is a vacuum-actuated, electrically controlled pump. If such a pump is actuated by engine intake manifold vacuum, then the engine must be run to perform the test.

A further benefit of positive pressurization over negative pressurization is that the increased pressure suppresses the rate of fuel vapor generation in the tank, and such attenuation of fuel vapor generation during a diagnostic test reduces the likelihood that the test will give, under hot weather conditions which promote fuel vapor generation, a false signal that would erroneously confirm the integrity of the canister and tank whereas the same test during cold weather would indicate a leak.

According to the disclosure of U.S. Pat. No. 5,146,902, atmospheric air is pumped directly into the fuel tank's headspace where it is entrained with fuel vapor that is already present. Concern has been expressed about pumping air directly into the fuel tank particularly if for some reason the pump continued to pump beyond the time when it should have shut off. Overpressurization of the tank headspace and vapor collection canister may create atypical pressures and/or air-fuel ratios in the canister/tank headspace. One possible consequence of overpressurization is that some fuel vapor may be forced out the atmospheric vent of the canister.

The invention of a related pending application comprises means for introducing the pumped air into the evaporative emission system that can alleviate the tendency toward such consequences; specifically it relates to introducing the pumped air into the evaporative emission system through an atmospheric vent port of the canister after that port has been closed to atmosphere by the closing of a canister vent solenoid (CVS) valve through which the canister is otherwise vented to atmosphere during non-test times.

Should the air pump continue to run for any reason after a diagnostic test has concluded, the pumped air will not be forced into the tank headspace. The pumped air will not even enter the canister, but rather will be returned to atmosphere through the CVS valve which re-opens at test conclusion to relieve the tank test pressure.

The canister contains an internal medium that collects fuel vapors so that the vapors do not pass to the atmospheric vent port. During a diagnostic test, air pumped into the canister vent port must pass through that medium before it can enter the tank headspace, and consequently it is fuel vapor laden air, rather than merely air alone, that pressurizes the tank headspace. The invention of the present patent application is, however, independent of the point at which the pressurized air is introduced so long as that point is in essentially unrestricted communication with the canister/tank headspace.

Common to the forgoing diagnostic test procedures involving positive pressurization is the fact that the tank is first pressurized to a certain pressure and then the diagnostic system looks for loss of pressure.

The present invention relates to a diagnostic system and method wherein testing is conducted during pressurization. As a result, it becomes possible to reduce the test time in comparison to the foregoing procedures.

Further specific details of the construction and arrangement of the inventive system, and of the method of operation thereof, along with additional features and benefits, will be presented in the ensuing description.

Drawings accompany this disclosure and portray a presently preferred embodiment of the invention according to the best mode presently contemplated for carrying out the invention.

DESCRIPTION OF THE PREFERRED EMBODIMENT

Figure 1:
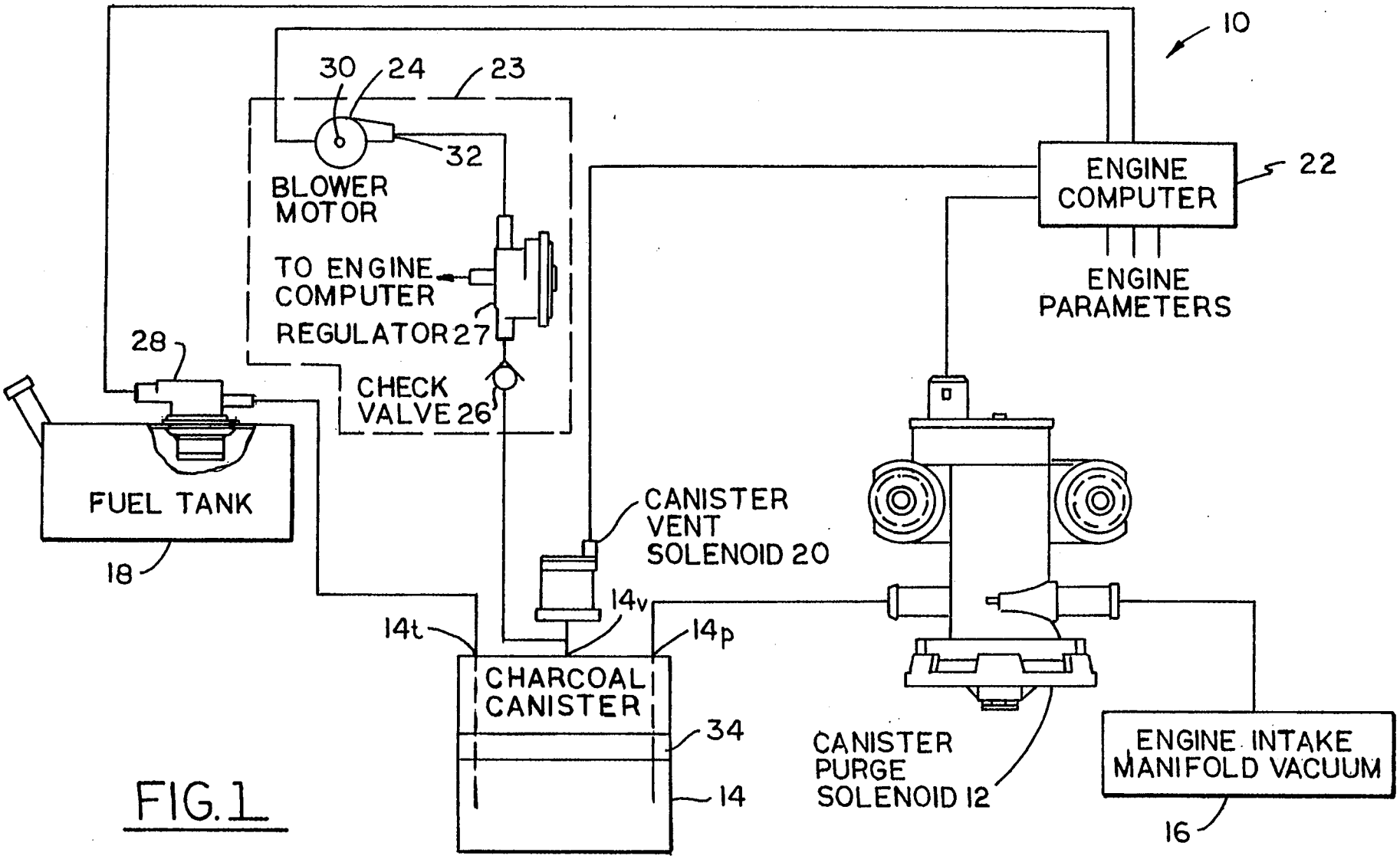
FIG. 1 is a schematic diagram of a representative canister purge system, including a diagnostic system embodying principles of the present invention.

FIG. 1 shows a representative canister purge system 10 embodying principles of the invention. System 10 comprises a canister purge solenoid (CPS) valve 12 and a charcoal canister 14 associated with the intake manifold 16 of an automotive vehicle internal combustion engine and with a fuel tank 18 of the automotive vehicle which holds a supply of volatile liquid fuel for powering the engine. Canister 14 comprises a tank port 14*t*, an atmospheric vent port 14*v*, and a purge port 14*p*. A normally closed canister vent solenoid (CVS) valve 20 is disposed between atmosphere and atmospheric vent port 14*v* of canister 14 to control the opening and closing of the canister atmospheric vent port 14*v* to atmosphere. Both CPS valve 12 and CVS valve 20 are under the control of an engine management computer 22 for the engine.

For use in conducting the on-board diagnostic testing that confirms integrity of the canister purge system against leakage, a pump means 23 is provided. Pump means 23 comprises an electric operated pump (blower motor) 24, a check valve 26, and a pressure regulator 27. An analog pressure transducer 28 is also provided to measure tank headspace pressure. Pump 24 has an air inlet 30 that is communicated to ambient atmospheric air and an air outlet 32 that is communicated to an inlet port of pressure regulator 27. Pressure regulator 27 has an outlet port that communicates through check valve 26 to canister vent port 14*v*, there being a tee via which the conduit from the check valve connects into the conduit between port 14*v* and CVS valve 20. There is a circuit connection whereby operation of pump 24 is controlled by computer 22.

Analog pressure transducer 28 is part of a combination transducer/roll-over valve like that described in commonly assigned pending application Ser. No. 07/876,254. The transducer senses pressure in the tank headspace and provides a corresponding signal to computer 22.

The canister purge system operates in conventional manner, and may be briefly described as follows. Under conditions conducive to purging, computer 22 causes the normally closed CPS valve 12 to open in a controlled manner. CVS valve 20 is open at this time since it is normally open at all times other than a diagnostic test. The result of opening CPS valve 12 is that a certain amount of the engine manifold vacuum is delivered to canister 14 via purge port 14*p* causing collected vapors to flow from the canister through CPS valve 12 to the engine manifold where they entrain with the induction flow entering the engine's combustion chamber space to be ultimately combusted.

The system functions in the following manner to perform a diagnostic test of the integrity against unacceptable leakage of that portion of the CPS system upstream of, and including, CPS valve 12. First, it may be deemed desirable to measure the pre-existing pressure in the tank/canister to assure that excessively high pressures that might adversely affect the validity of a test are not present. In such a case, after computer 22 has commanded CPS valve 12 and CVS valve 20 to close, it reads the pressure from transducer 28. If too high a pre-existing positive pressure condition exists in the tank/canister, the test is deferred to a later time, and in this regard it should be mentioned that the timing at which tests are attempted is determined by various other inputs to or programs of computer 22 that need not be mentioned here. It is believed that the most favorable test condition occurs when the engine is cold and ambient temperature low, and hence a typical schedule may comprise conducting a test each time the engine is started. If a start is a hot start and/or if the ambient temperature is high; it is possible that an accurate test cannot be conducted, and in such case the measurement of tank pressure at the beginning of a test may be used to determine whether a valid test can be conducted at the time. Assuming that a suitable tank pressure for conducting the test is detected by computer 22 reading transducer 28 at the beginning of a test, then the pre-existing pressure in the tank/canister is deemed suitable for the test to proceed.

The test proceeds by computer 22 commanding pump 24 to operate and thus increasingly positively pressurize the tank/canister. Air is pumped into the tank/canister via canister 14. Canister 14 contains an internal medium 34, charcoal for example, that collects fuel vapors emitted from volatile fuel in the tank. The air pumped into vent port 14*c* must pass through this medium, and therefore some of the collected fuel vapor will entrain with the pumped air as it passes through the canister to the tank headspace. Consequently, an air/fuel mixture, rather than merely air alone, pressurizes the tank headspace. This will avoid creating atypical air-fuel mixtures in the tank headspace. As the pump operates, the tank/canister positive pressure should build. However, the presence of a grossly unacceptable leak in the tank/canister could prevent the pressure from building to a predetermined positive pressure within a predetermined time. Thus, if transducer 28 fails to detect the attainment of a predetermined tank pressure within a predetermined amount of time, a fault is indicated. Such fault may be attributed to any one or more of: a gross leak in the tank/canister, faulty circuit connections, a faulty pump 24, a faulty check valve 26, or a faulty transducer 28. In such an event the test is terminated and a fault indication given.

However, if the pressure in the tank/canister builds within a predetermined time, then the test proceeds. Check valve 26 functions to prevent loss of pressure back through the pump. This traps the pressure in the tank/canister. If a leak which is less than a gross leak is present in the tank/canister, positive pressure will build more slowly than if there were no leak at all. For a given fuel fill level in the tank, the rate at which the positive pressure builds in the tank/canister is a function of the severity of the leak. Since the pressurizing air is being introduced into the canister purge system from a source whose outlet has a known constant cross sectional area and is at a known positive pressure, the time for the pressure in the tank/canister to build to a given level from an initial starting pressure will be an indicator of the size of leakage present for a given fuel fill level in the tank. Thus, a determination of the fuel fill level in the tank is also an input to computer 22.

At the start of a test, computer 22 reads both the pressure sensed by transducer 28 and the fuel fill level. The computer then measures the amount of time required for the tank/canister pressure to build to a certain level from the starting pressure. Computer 22 is programmed with data correlating pressure rise time with effective leak size for different starting and ending pressures and different fuel fill levels so that for the particular pressure and particular fuel fill level measured at the beginning of a test, the effective size of a leak is correlated with the amount of time required for the pressure to build to a selected higher pressure. It is therefore possible to obtain a reasonably accurate measurement of leakage present. A selected amount of leakage may define an upper limit for tolerable leakage so that a measurement exceeding that limit will indicate an unacceptable amount of leakage. The maximum pressure to which the tank/canister pressure can build is equal to the regulated pressure output of the pressurizing source, and that would represent an upper limit for the build pressure at which timing is stopped. Timing can of course be stopped at a lower pressure.

It may be mentioned at this point that the invention can enable a test to be performed at relatively small positive pressure levels in the canister and fuel tank so that the pressure will not cause deformation of properly designed canisters and tanks. At the completion of a test the CPS valve is once again operated by computer 22 in the usual way for conducting canister purging.

If a diagnostic test is conducted above a certain temperature, it is possible that fuel vapors may be generated in the tank at a rate that is sufficiently fast that the increase in vapor pressure will mask at least to some extent the existence of a leak. This tendency is somewhat better countered by positive pressurization testing because such pressurization tends to attenuate the vapor generation rate.

Correction factors may be programmed into data storage media of computer 22. An additional sensor input, such as fuel temperature can be used by the computer to select an appropriate correction factor based on actual fuel temperature and apply the appropriate correction factor to the measurement. Correction for the rate of vapor generation may be made by measuring the rate of vapor generation at the beginning of a test and then utilizing the measurement to correct the test results. The rate is determined by closing the evaporative emission space, and measuring the pressure rise over a given period of time. This measurement is stored in memory, and used later to correct the result of a subsequently performed diagnostic test, as described above. Assuming that the effective size of any leakage remains constant, the presence or absence of any such leakage has no net effect on the corrected result because the correction measurement is made on the system as it actually exists, leakage or not, and the effect of leakage will cancel out when the correction measurement is applied. Fuel temperature may be measured either directly by a fuel temperature sensor or indirectly by a sensor that senses temperature of a parameter that is reasonably correlated with fuel temperature. Likewise, the rate of fuel vapor pressure generation may be measured by a suitable sensor, either directly or indirectly.

Having disclosed generic principles of the invention, this application is intended to provide legal protection for all embodiments falling within the scope of the following claims.

What is claimed is:

1. A canister purge system comprising a collection canister for collecting volatile fuel vapors from a fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path between said canister and intake manifold, characterized by an associated diagnostic system for detecting leakage from a portion of the canister purge system, which portion includes said canister and tank, said diagnostic system comprising pump means for delivering pumped air at a predetermined regulated pressure to build positive pressure in said portion during a diagnostic test, pressure sensing means for sensing pressure in said portion, timing means for measuring the length of time for the pressure in said portion to build from a first pressure measured at the beginning of the diagnostic test to a second higher pressure, and determining means for determining from the length of time measured by said timing means the extent of any leakage from said portion, in which said determining means comprises means for utilizing a measurement of the fuel fill level in said tank in determining the extent of any leakage from said portion.

2. A canister purge system as set forth in claim 1 in which said second higher pressure is substantially equal to said predetermined regulated pressure delivered by said pump means.

3. A canister purge system as set forth in claim 1 in which said pump means comprises a pump, a pressure regulator, and a check valve, in that order, connected to the canister purge system.

4. A canister purge system as set forth in claim 1 further including correction factor means comprising means for storing correction factors based on at least one of fuel temperature and rate of fuel vapor generation in the tank, and means for applying said correction factors to the determination of said determining means to correct for at least one of actual fuel temperature and actual rate of fuel vapor generation in the tank.

5. In a canister purge system comprising a collection canister for collecting volatile fuel vapors from a fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path between said canister and intake manifold, a diagnostic method for detecting leakage from a portion of the canister purge system, which portion includes said canister and tank, said method comprising positively pressurizing said portion from a source of pressurized fluid at substantially constant pressure to build positive pressure in said portion during a diagnostic test, sensing pressure in said portion, measuring the length of time for the pressure in said portion to build from a first pressure measured at the beginning of the diagnostic test to a second higher pressure, and determining from the length of time measured by said timing means the extent of any leakage from said portion, in which said determining step comprises utilizing a measurement of the fuel fill level in said tank in determining the extent of any leakage from said portion.

6. A method as set forth in claim 5 in which said second higher pressure is substantially equal to said substantially constant pressure.

7. A method as set forth in claim 5 in which said step of positively pressurizing said portion from a source of pressurized fluid comprises drawing air from ambient atmosphere and compressing it to create said pressurized fluid.

8. A method as set forth in claim 5 in which said air is passed through said canister so that air entering said portion is entrained with fuel vapor previously collected in said canister.

9. A method as set forth in claim 5 in which said determining step comprises correcting the leakage measurement for at least one of actual fuel temperature and actual rate of fuel vapor generation in the tank.

10. A canister purge system comprising a collection canister for collecting volatile fuel vapors from a fuel tank, and means for selectively purging collected fuel vapors from said canister to an internal combustion engine's intake manifold for entrainment with a combustible mixture that passes from the intake manifold into combustion chamber space of the engine for combustion therein, said means including a purge flow path between said canister and intake manifold, characterized by an associated diagnostic system for detecting leakage from a portion of the canister purge system, which portion includes said canister and tank, said diagnostic system comprising means for pressurizing said portion from a source of pressurized fluid at substantially constant pressure to build positive pressure in said portion during a diagnostic test, pressure sensing means for sensing pressure in said portion, timing means for measuring the length of time for the pressure in said portion to build from a first pressure measured at the beginning of the diagnostic test to a second higher pressure, and determining means for determining from the length of time measured by said timing means the extent of any leakage from said portion, in which said determining means comprises means for utilizing a measurement of the fuel fill level in said tank in determining the extent of any leakage from said portion.

11. A canister purge system as set forth in claim 10 in which said second higher pressure is substantially equal to said substantially constant pressure.

12. A canister purge system as set forth in claim 10 in which said source of pressurized fluid comprises a pump, a check valve, and a pressure regulator.

13. A canister purge system as set forth in claim 12 in which pump is electrically operated to draw air from ambient atmosphere and compress it to create said pressurized fluid.

14. A canister purge system as set forth in claim 13 comprising means for causing said air to pass through said canister so that air entering said portion is entrained with fuel vapor previously collected in said canister.

15. A canister purge system as set forth in claim 10 further including correction factor means comprising means for storing correction factors based on at least one of fuel temperature and rate of fuel vapor generation in the tank, and means for applying said correction factors to the determination of said determining means to correct for at least one of actual fuel temperature and actual rate of fuel vapor generation in the tank.

* * * * *